US005778954A

United States Patent [19]

Sullivan et al.

[11] Patent Number: 5,778,954

[45] Date of Patent: Jul. 14, 1998

[54] WALLET/POCKET KNIFE HOLDER

[75] Inventors: John Sullivan, Bradford, Pa.; Edward L. Jessup, Jr., Knoxville, Tenn.

[73] Assignee: W.R. Case & Sons Cutlery Company, Bradford, Pa.

[21] Appl. No.: 795,594

[22] Filed: Sep. 9, 1996

[51] Int. Cl.[6] ..... A45C 1/06

[52] U.S. Cl. ..... 150/143; 150/132; 150/146; 150/147; 224/232

[58] Field of Search ..... 150/131, 132, 150/138, 143, 145, 146, 147; 206/37, 38; 224/232

[56] References Cited

U.S. PATENT DOCUMENTS

| | | | |
|---|---|---|---|
| 2,219,561 | 10/1940 | Miller | 150/132 X |
| 3,267,980 | 8/1966 | Bird | 150/138 X |
| 4,153,093 | 5/1979 | Mahabir | 150/143 X |
| 4,316,492 | 2/1982 | Plough et al. | 150/143 |
| 4,332,338 | 6/1982 | Christiansen | 150/143 X |
| 4,682,310 | 7/1987 | Lund et al. | 150/131 X |
| 4,796,750 | 1/1989 | Inghram | 150/131 X |
| 5,230,627 | 7/1993 | Todd | 150/146 X |

*Primary Examiner*—Stephen Cronin

*Attorney, Agent, or Firm*—Hodgson, Russ, Andrews, Woods & Goodyear; Christine Johnson

[57] ABSTRACT

A combination of a wallet and a pocket knife. The wallet has a plurality of sections which overlie each other when the wallet is folded. One of the sections has a pocket which removably and frictionally receives a pocket knife.

15 Claims, 2 Drawing Sheets

WALLET/POCKET KNIFE HOLDER

The present invention relates generally to wallets or bill-folds.

It is an object of the present invention to provide a means for a person to conveniently carry a pocket knife.

U.S. Pat. No. 2,219,561 discloses a bill-fold in which is incorporated a key container. U.S. Pat. Nos. 781,948; 2,771,928; and 4,555,018 disclose means for carrying around pens or pencils.

In accordance with the present invention, a wallet contains a pocket for removably and frictionally receiving a pocket knife so that the pocket knife may be conveniently carried by a person.

The above and other objects, features, and advantages of the present invention will be apparent in the following detailed description of the preferred embodiment thereof when read in conjunction with the accompanying drawings wherein the same reference numerals denote the same or similar parts throughout the several views.

DETAILED DESCRIPTION OF THE PREFERRED EMBODIMENT

Figure 2:
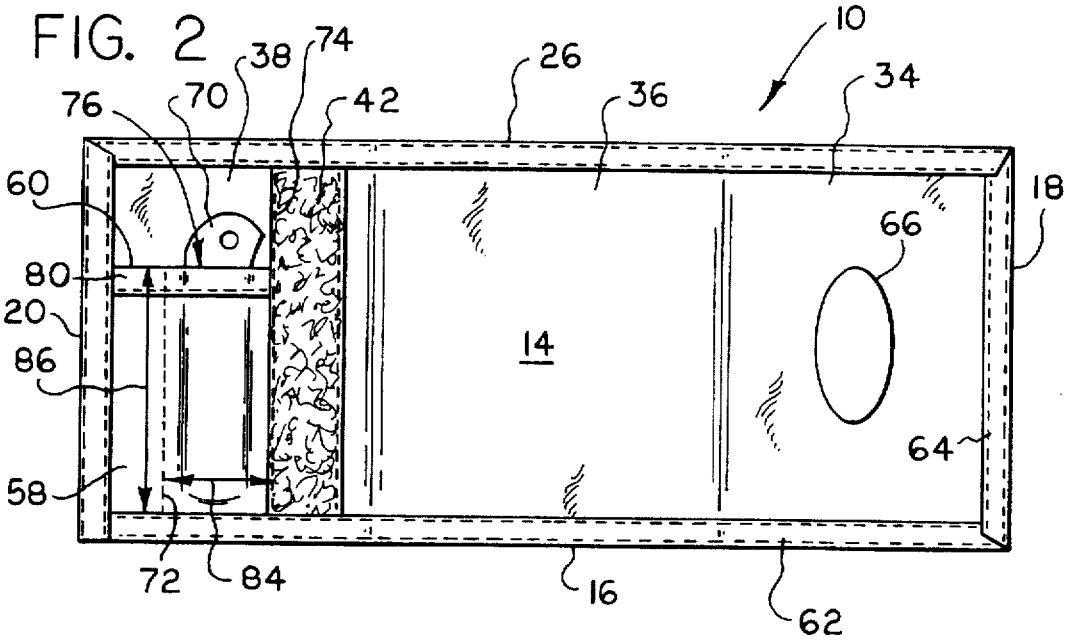
FIG. 2 is a plan view of the exterior of the wallet, as unfolded.
Figure 3:
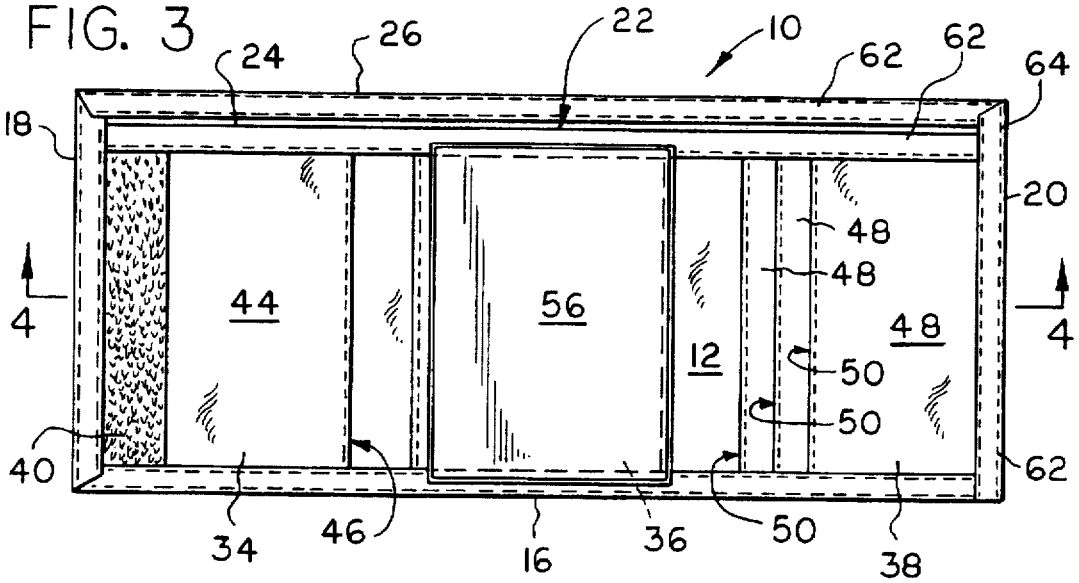
FIG. 3 is a plan view of the interior of the wallet, as unfolded.
Figure 4:
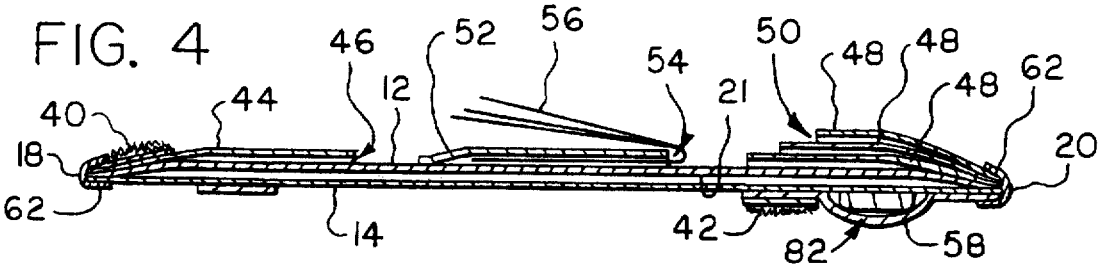
FIG. 4 is a sectional view thereof taken along lines 4—4 of FIG. 3.

Referring to the drawings, there is shown generally at 10 a wallet or bill-fold, which is composed of a suitable material as hereinafter described and which is typically carried by a man in his rear pants pocket. When unfolded, as in FIGS. 2 and 3, the wallet has a length for carrying dollar bills. The wallet is foldable to a size to fit in a pants pocket. For example, when unfolded, the wallet may have a length of perhaps about 10 inches as well as a width of perhaps about 4½ inches. As tri-folded, the wallet may have a size of perhaps about 3½ inches by 4½ inches suitable for carrying in one's pocket. While the wallet shown in the drawings is of a tri-fold type, it should be understood that it may be of a bi-fold type or otherwise suitably foldable.

The wallet 10 includes interior and exterior panels 12 and 14 which are sewn together or otherwise suitably attached along their bottom edge 16 and end edges 18 and 20 to form a compartment 21 having an upper opening, illustrated at 22, for receiving bills. The exterior panel 14 extends beyond the upper edge 24 of the interior panel 12 so that the upper edge 26 of the exterior panel is upwardly of edge 24 to allow the opening 22 to be easily reached. A suitable lining material (not shown for ease of illustration) may be provided to line the panels 12 and 14 respectively within the compartment 21.

Figure 1:
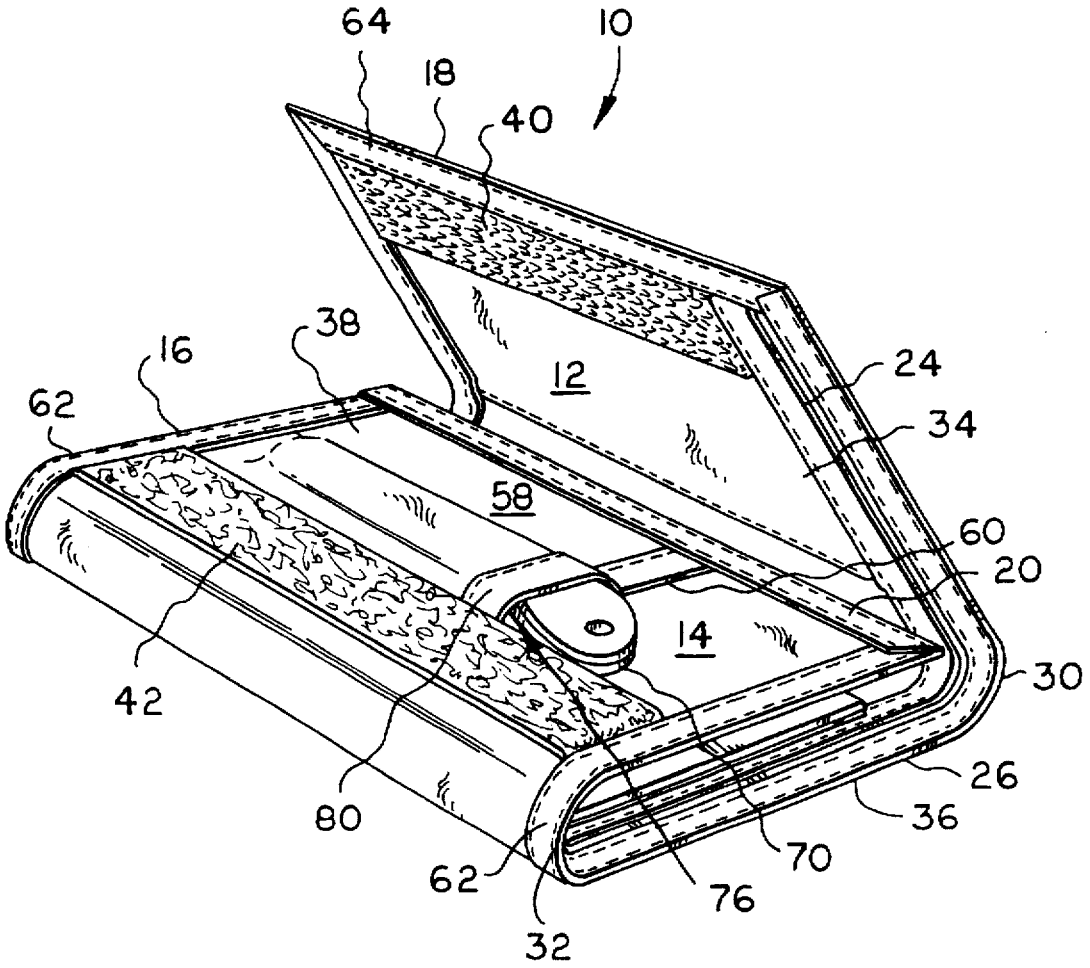
FIG. 1 is a perspective view of a partially unfolded wallet which embodies the present invention.

As previously discussed, the wallet 10 is of a tri-fold type, providing folds generally at 30 and 32 defining first, second, and third sections 34, 36, and 38 with the second section 36 being centrally disposed between sections 34 and 38. Section 34 defines or extends to end edge 18, and section 38 defines or extends to end edge 20. As seen in FIG. 1, when the wallet 10 is folded so that it may be carried in one's pocket, the sections 34, 36, and 38 overlie each other with the third section 38 being sandwiched between the first and second sections 34 and 36 respectively.

A panel 44 is sewn to interior panel 12 alongside the end edge 18 (on first section 34) to define a card pocket having opening 46. A plurality of perhaps three panels 48 are sewn to interior panel 12 alongside the end edge 20 (on third section 38) to overlie each other to define card pockets having openings 50 which are spaced so that all of the card pockets may be easily accessed. Another panel 52 is sewn to interior panel 12 alongside fold 30 (on second section 36) to define a pocket having an opening 54 alongside fold 32 for receiving cards or the cord holder illustrated at 56. A panel 58 is sewn to the exterior panel 14 and extends over the width of the third section 38 and has an upper edge 60 which is spaced from the upper edges 24 and 26. Its purpose will be discussed hereinafter.

A strip 40 of hook and loop fastener material commonly known as Velcro material, having a width of perhaps about ¾ inch, is sewn to the panel 44 alongside the end edge 18. A mating strip 42 of hook and loop fastener material is sewn on the third section 38 to the panel 58 and to the exterior panel 14 above the edge 60 and alongside the edge thereof which defines the fold 32. Thus, the wallet 10 is foldable so that the fastener strips 40 and 42 engage each other to close the wallet. It should be understood that other suitable fasteners may be provided to close the wallet, or the wallet may not be provided with no fasteners at all for closing it.

Edging material, illustrated at 62, is suitably sewn along the edges 16, 18, 20, 24, and 26 and to the various panels respectively. The edging material defines the edges of panels to which it is applied. Sewing is illustrated by stitches 64. A logo or decorative design may be placed on the exterior panel, as illustrated at 66. Illustrated at 70 is a conventional small pocket knife, i.e., it may have a length and thickness of, for example, perhaps about 3 inches and 5/16 inch respectively. Its width may vary from, for example, perhaps about ¾ inch at one end to ½ inch at the other end.

In accordance with the present invention, the panel 58 is further sewn, as by stitches 72, to the exterior panel 14 to form a pocket 82 between the stitching 72 and stitching 74 (of fastener material 42 to the exterior panel) having upper opening 76 for receiving the pocket knife 70. The panel 58 is further sewn, as by stitches 78, to the exterior panel 14 along the upper edge 60 over the distance between stitching 72 and the end edge 20. Edging 80 is suitably sewn to the upper edge 60 of the panel 58. The knife pocket 82 is thus desirably located generally centrally of the width of the third section 38.

Further in accordance with the present invention, in order that a person may be able to easily secure the pocket knife within the pocket in such a manner that it is easily removable, the knife pocket 82 is sized relative to the size of the knife 70 to provide a pocket width, illustrated at 84, which will fictionally or snugly or tightly hold or grip the knife 70 so that it does not fall out when the unfolded wallet is atypically held upside down. Moreover, when the wallet is folded, the knife 70 is sandwiched between the first and third sections 34 and 38 respectively for additional security, and this sandwiched relation is insured by the fastening strips 40 and 42. Thus, the width 84 of the pocket is a little greater than a knife width, i.e., substantially equal to a knife width, and the pocket 82 as well as the rest of the wallet is desirably composed of a suitably coarse material which will accommodate or impart the desired frictional relation between the knife and pocket. For example, the pocket width 84 (with the knife removed) for the exemplary knife size described above may perhaps be about 1⅛ inch, and the wallet 10 and particularly the panels 14 and 58 may be composed of ballistic nylon material. Other suitable materials may of course be employed.

The pocket length (height), illustrated at 86, is a little less than the knife length to permit the knife to protrude from the opening when the knife is closed and fully inserted in the pocket so that it may be grabbed to pull the knife from the pocket 82. For example, for the exemplary knife size described above, the pocket length 86 may perhaps be about 2¾ inches.

Thus, the wallet-10 having the pocket 82 is provided so that a pocket knife may be securely and conveniently carried by a person.

It should be understood that, while the invention has been described in detail herein, the invention can be embodied otherwise without departing from the principles thereof, and such other embodiments are meant to come within the scope of the present invention as defined by the appended claims.

What is claimed is:

1. In combination, a wallet including a plurality of sections, means for folding said wallet so that said sections overlie each other, and pocket means on at least one of said sections, and a knife removably receivable in said pocket means, said pocket means being sized for frictionally receiving said knife.

2. A combination according to claim 1 wherein said knife is a pocket knife.

3. A combination according to claim 2 wherein said pocket means is sewed to said at least one section to have a width equal substantially to a width of said knife and has a height such that said knife protrudes from an opening of said pocket means when said knife is closed and fully inserted therein.

4. A combination according to claim 1 wherein said plurality of sections comprises three of the sections.

5. A combination according to claim 1 further comprising means for securing said wallet closed.

6. A combination according to claim 5 wherein said knife is a pocket knife.

7. A combination according to claim 1 wherein said wallet including said pocket means is composed of a ballistic nylon material.

8. In combination, a wallet having first, second, and third sections with said second section being centrally disposed between said first and third sections, means for folding said wallet so that said sections overlie each other with said third section being sandwiched between said first and second sections, means for fastening said first and third sections together to close the wallet, and means defining a pocket on at least one of said sections which is sized for frictionally receiving a pocket knife, and a pocket knife removably and frictionally receivable in said pocket.

9. A combination according to claim 8 wherein said pocket is sewed to said at least one section to have a width equal substantially to a width of said pocket knife and has a height such that said pocket knife protrudes from an opening of said pocket when said pocket knife is closed and fully inserted therein.

10. A combination according to claim 8 wherein said wallet including said pocket is composed of a ballistic nylon material.

11. In combination, a wallet having an interior panel and an exterior panel connected together along bottom and end edge portions of said wallet to define a compartment for bills and including first, second, and third sections extending between said end edge portions with said first section containing one of said end edge portions and said third section containing an other of said end edge portions and with said second section being centrally disposed between said first and third sections, means for folding said wallet so that said sections overlie each other with said third section being sandwiched between said first and second sections, cooperating strips of hook and loop fastener means on said one edge portion and on said third section respectively for securing said wallet closed, and means defining a pocket disposed on said exterior panel between said third section strip and said other edge portion for frictionally receiving a pocket knife, and a pocket knife removably and frictionally receivable in said pocket.

12. A combination according to claim 11 wherein said pocket is sewed to said exterior panel to have a width equal substantially to a width of said pocket knife and has a height such that said pocket knife protrudes from an opening of said pocket when said pocket knife is closed and fully inserted therein.

13. A combination according to claim 12 wherein said wallet including said pocket is composed of a ballistic nylon material.

14. A combination according to claim 11 wherein said wallet including said pocket is composed of a ballistic nylon material.

15. A combination according to claim 11 further comprising means defining card pockets on said interior panel.

* * * * *